US005587269A

United States Patent [19]

Defieuw

[11] Patent Number: 5,587,269

[45] **Date of Patent: * Dec. 24, 1996**

[54] THERMAL TRANSFER IMAGING PROCESS AND DONOR ELEMENT FOR USE THEREIN

[75] Inventor: Geert Defieuw, Kessel-Lo, Belgium

[73] Assignee: Afga-Gevaert N.V., Mortsel, Belgium

[ * ] Notice: The term of this patent shall not extend beyond the expiration date of Pat. No. 5,587,269.

[21] Appl. No.: 400,346

[22] Filed: Mar. 8, 1995

[30] Foreign Application Priority Data

Mar. 25, 1994 [EP] European Pat. Off. ..... 94200788

[51] Int. Cl.[6] ..... G03C 8/40; G03C 8/44

[52] U.S. Cl. ..... 430/203; 430/200; 430/202; 430/350; 430/617; 430/950

[58] Field of Search ..... 430/3, 22, 950, 430/348, 617, 200, 201, 964, 256, 203, 202, 350, 631

[56] References Cited

U.S. PATENT DOCUMENTS

| | | | |
|---|---|---|---|
| 3,218,166 | 11/1965 | Reitter . | |
| 3,767,414 | 10/1973 | Huffman et al. | 96/114 |
| 4,032,690 | 6/1977 | Kohmura et al. | 430/348 |
| 5,310,640 | 5/1994 | Markin et al. | 430/527 |
| 5,322,833 | 6/1994 | Defieuw et al. | 503/227 |
| 5,380,607 | 1/1995 | Van Haute et al. | 430/3 |
| 5,384,238 | 1/1995 | Ellis | 430/617 |

FOREIGN PATENT DOCUMENTS

| | | | |
|---|---|---|---|
| 246832 | 9/1962 | Australia | 430/346 |

*Primary Examiner*—Thorl Chea

*Attorney, Agent, or Firm*—Brumbaugh, Graves, Donohue & Raymond

[57] ABSTRACT

The present invention provides a thermal imaging process using (i) a donor element comprising on a support having a thickness of 3–10 μm a donor layer comprising a binder, a thermotransferable reducing agent capable of reducing a silver source to metallic silver upon heating and particles protruding from the surface of said donor layer and (ii) a receiving element comprising on a support a receiving layer comprising a silver source capable of being reduced by means of heat in the presence of a reducing agent, said thermal imaging process comprising the steps of bringing said donor layer of said donor element into face to face relationship with said receiving layer of said receiving element, image-wise heating a thus obtained assemblage, thereby causing image-wise transfer of an amount of said thermotransferable reducing agent to said receiving element in accordance with the amount of heat supplied by said thermal head and separating said donor element from said receiving element.

The obtained images have a uniform density and the donor element for use in the above method shows an improved storage stability.

8 Claims, No Drawings

THERMAL TRANSFER IMAGING PROCESS AND DONOR ELEMENT FOR USE THEREIN

DESCRIPTION

1. Field of the Invention

The present invention relates to a thermal imaging process, more particularly to a donor element for use according to thermal transfer printing of a reducing agent and said donor element having a higher stability.

2. Background of the Invention

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes color or optical density.
2. Formation of a visible image pattern by transfer of a colored species from an imagewise heated donor element onto a receptor element.

A survey of "direct thermal" imaging methods is given in the book "Imaging Systems" by Kurl I. Jacobson-Ralph E. Jacobson, The Focal Press London and New York (1976), Chapter VII under the heading "7.1 Thermography" Thermography is concerned with materials which are not photosensitive, but are heat sensitive. Imagewise applied heat is sufficient to bring about a visible change in a thermosensitive imaging material.

According to a direct thermal embodiment operating by physical change, a recording material is used which contains a colored support or support coated with a colored layer which itself is overcoated with an opaque white light reflecting layer that can fuse to a clear, transparent state whereby the colored support is no longer masked. Physical thermographic systems operating with such kind of recording material are described on pages 136 and 137 of the above mentioned book of Kurt I. Jacobson et al.

Yet most of the "direct" thermographic recording materials are of the chemical type. On heating to a certain conversion temperature, an irreversible chemical reaction takes place and a colored image is produced.

It has been suggested to use a thermoreducable silver source in combination with a reducing agent in a direct thermal film in order to increase the optical density in transmission of a printed image (see EP-A-537.975). Although continuous tones can be obtained by said printing method, the gradation produced by said printing method is too high resulting in only a few intermediate density levels. Fluctuations in the heat transfer from the heat source to the printing material result in a density difference of the final image. Thus, it is extremely difficult to obtain images having a uniform density profile. A direct thermal printing method moreover has the disadvantage that in the non-image places the co-reactants always remains unchanged, impairing the shelf-life and preservability.

Thermal dye transfer printing is a recording method wherein a dye-donor element is used that is provided with a dye layer wherefrom dyed portions or incorporated dye is transferred onto a contacting receiving element by the application of heat in a pattern normally controlled by electronic information signals.

In European Patent Application No. 94200612.3, a thermal imaging process is provided using (i) a donor element comprising on a support a donor layer containing a binder and a thermotransferably reducing agent capable of reducing a silver source to metallic silver upon heating and (ii) a receiving element comprising on a support a receiving layer comprising a silver source capable of being reduced by means of heat in the presence of a reducing agent, said thermal imaging process comprising the steps of bringing said donor layer of said donor element into face to face relationship with said receiving layer of said receiving element, image-wise heating a thus obtained assemblage by means of a thermal head, thereby causing image-wise transfer of an amount of said thermotransferable reducing agent to said receiving element in accordance with the amount of heat supplied by said thermal head, and separating said donor element from said receiving element.

This printing method is further referred to as 'reducing agent transfer printing' or 'RTP'.

However, the stability of the donor element in said European Patent Application has been found to be poor. More particularly, the donor layer tends to stick to the back side of the donor element when stored in stacked or rolled form. This leads to bad transport properties. Moreover, part of the donor layer is transferred to the back side of the donor element.

This problem is more severe when a larger amount of reducing agent is used in the donor layer. These large amounts are preferred to obtain high optical densities of the final printed images (above 2.0–2.5). The sticking problem is also believed to be so high due to the fact that a lot of reducing agents such as e.g. pyrocatechol and pyrocatechol derivatives are known to be swelling agents for polymers such as polyethylene terephthalate. The sticking problem is especially seen when a thin support is used (3–10 μm thickness).

OBJECT OF THE PRESENT INVENTION

It is an object of the present invention to provide a thermal imaging process yielding images having a high optical density, using a donor element having an excellent storage stability.

Further objects will become apparent from the description hereinafter.

According to the present invention, there is provided a thermal imaging process using (i) a donor element comprising on a support, preferably having a thickness of 3–10 μm, a donor layer comprising a binder, a thermotransferable reducing agent capable of reducing a silver source to metallic silver upon heating and particles protruding from the surface of said donor layer and (ii) a receiving element comprising on a support a receiving layer comprising a silver source capable of being reduced by means of heat in the presence of a reducing agent, said thermal imaging process comprising the steps of bringing said donor layer of said donor element into face to face relationship with said receiving layer of said receiving element, image-wise heating a thus obtained assemblage preferably by means of a thermal head, thereby causing image-wise transfer of an amount of said thermotransferable reducing agents to said receiving element in accordance with the amount of heat supplied separating said donor element from said receiving element.

The present invention further provides a thermal imaging system consisting of (i) a donor element comprising on a support having a thickness of 3–10 μm a donor layer comprising a binder, a thermotransferable reducing agent capable of reducing a silver source to metallic silver upon heating and particles protruding from the surface of said donor layer and (ii) a receiving element comprising on a support a receiving layer comprising a silver source capable of being reduced by means of heat in the presence of a reducing agent.

DETAILED DESCRIPTION OF THE INVENTION

The donor element for use according to present invention comprises on one side of The support a donor layer, comprising a reducing agent capable of reducing a silver source to metallic silver upon heating, a binder and particles protruding from the surface of said donor layer.

The reducing agent for the silver source may comprise any of the conventional photographic developers known in the art, such as phenidones, hydroquinones and catechol provided that the reducing agent is thermotransferable.

Examples of suitable reducing agents are aminohydroxycycloalkenone compounds, esters of amino reductones, N-hydroxyurea derivatives, hydrazones of aldehydes and ketones, phosphoramidophenols, phosphoramidoanilines, polyhydroxybenzenes, e.g. hydroquinone, t-butylhydroquinone, isopropylhydroquinone, and (2,5-dihydroxyphenyl)methylsulfone, dihydroxybenzene derivatives such as pyrocatechol, and pyrogallol derivatives such as 4-phenylpyrocatechol, t-butylcatechol, pyrogallol, or pyrogallol derivatives such as pyrogallol ethers or esters, dihydroxybenzoic acid, dihydroxybenzoic acid esters such as dihydroxybenzoic acid, methyl ester, ethyl ester, propyl ester, butyl ester and the like, dihydroxy benzaldehyde and keton derivatives, gallic acid, gallic acid esters such as methyl gallate, ethyl gallate, propyl gallate and the like, gallic acid amides, sulfhydroxamic acids, sulfonamidoanilines, 2-tetrazolylthiohydroquinones, e.g., 2-methyl-5-(1-phenyl-5-tetrazolylthio) hydroquinone, tetrahydroquinoxalines, e.g. 1,2,3,4-tetrahydroquinoxaline, amidoximes, azines, hydroxamic acids, 5-pyrazolones, sulfonamidophenol reducing agents, 2-phenylindan-1,3-dione and the like, 1,4-dihydropyridines, such as 2,6-dimethoxy-3,5-dicarbethoxy-1,4-dihydropyridine, bisphenols, e.g., bis(2-hydroxy-3-t-butyl-5-methylphenyl) methane, bis(6-hydroxy-m-toly) mesitol, 2,2-bis(4-hydroxy-3-methylphenyl)propane, 4,4-ethylidene-bis(2-t-butyl-6-methylphenol) and 2,2-bis(3,5-dimethyl-4-hydroxyphenyl) propane, ascorbic acid derivatives and 3pyrazolidones.

Reducing agents derived from 1,2-dihydroxy or 1,2,3-trihydroxyphenyl compounds are especially preferred. Highly preferred are 4-phenyl pyrocatechol, propyl gallate and dihydroxybenzoic acid alkyl esters.

As a binder for the donor layer, hydrophilic or hydrophobic binders can be used, although the use of hydrophobic binders is preferred.

Hydrophilic binders which can be used are polyvinylalcohol, gelatine, polyacrylamide and hydrophilic cellulosic binders such as hydroxyethyl cellulose, hydroxypropyl cellulose and the like.

The hydrophobic binders may be used as a dispersion in e.g. water or as a solution in an organic solvent.

Suitable binders for the donor layer are cellulose derivatives, such as ethyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derivated from acrytates and acrylate derivatives, such as polymethyl methacrylate and styrene-acrylate copolymers; polyester resins; polycarbonates; copoly(styreneoco-acrylonitrile); polysulfones; polyphenylene oxide; organosilicones, such as polysiloxanes; epoxy resins and natural resins, such as gum arabic. Preferably, the binder for the donor layer of the present invention comprises poly(styrene-co-acrylonitrile).

The binder for the donor layer preferably comprises a copolymer comprising styrene units and acrylonitrile units, preferentially at least 60% by weight of styrene units and at least 25% by weight of acrylonitrile units binder. The binder copolymer may comprise other comonomers than styrene units and acrylonitrile units. Suitable other comonomers are e.g. butadiene, butyl acrylate, and methyl methacrylate. The binder copolymer preferably has a glass transition temperature of at least 50° C.

It is also possible to use a mixture of the copolymer comprising styrene units and at least 15% by weight of acrylonitrile units with another binder known in the art, but preferably the acrylonitrile copolymer is present in an amount of at least 50% by weight of the total amount of binder.

The donor layer generally has a thickness of about 0.2 to 5.0 μm, preferably 0.4 to 2.0 μm, and the amount ratio of reducing agent to binder generally ranges from 9:1 to 1:3 by weight, preferably from 3:1 to 1:2 by weight.

The protruding particles in connection with the present invention are preferably uniformly distributed throughout the donor layer and preferably have an average particle size exceeding the thickness of the donor layer so as to protrude from the surface of the layer. During image-wise heating of the donor element they may remain fixed in the donor layer or they may transfer to the receiver sheet.

The particles used in accordance with the present invention preferably have a weight average particle size ranging from 0.3 to 40 μm, and more preferably from 1.5 to 8 μm.

The particles may be thermomeltable (wax particles) or non-thermomeltable (solid particles).

The wax particles used for the purpose of the present invention can be any of the water-insoluble thermoplastic wax-like materials of the known six classes of waxes i.e. vegetable waxes, insect waxes, such as bees wax, animal waxes, mineral waxes, petroleum waxes, synthetic waxes, as well as the water-insoluble wax-like components that occur individually in these waxes, more particularly long-chain hydrocarbons, saturated, unsaturated, branched, and unbranched fatty acids and alcohols, as well as the ethers and esters of aliphatic monohydric alcohols.

Preferentially, the wax particles used in accordance with the present invention are selected from the group consisting of polyolefin waxes, ester waxes, and amide waxes. According to an even more preferred embodiment the wax is a polyethylene wax. According to another preferred embodiment the amide wax is an ethylene-bis-stearamide wax such as Ceridust 3910 (trade name) Hoechst, Germany.

Preferably, it does not dissolve together with the binder and the reducing agents in the solvent or solvent mixture used to form a coating or printing composition that is applied to a support, which may have been provided first with an adhesive or subbing layer.

It may be advantageous to combine two or more waxes.

Examples of wax particles that can be used according to the present invention in combination with the binder and the reducing agent are:

Polyolefin wax particles consisting of or comprising:

Lancowax PE1544 (polyethylene particles of 1 to 10 μm and melting point 130° C.), supplied by Langer, Cray-valley, Belgium, Lancowax PE1500 (polyethylene particles of 4 μm and melting point 110° C.) also supplied by Langer, Aqua Poly AP250 (polyethylene particles smaller than 13 μm and melting point between 117° and 123° C.) supplied by Floridienne, Brussels, Belgium, Micronised synthetic waxes MP22C (polyethylene particles smaller than 10 μm and melting point between 101° and 106° C.) and 620XF (polyethylene particles smaller than 8 μm and melting point 110° C.) both supplied by Floridienne, Brussels, Belgium, Microthene FN500 (polyethylene particles of about 20 μm and melting point between 96° and 112° C.) and FN510 (polyethylene particles of about 30 μm and melting point 97° C.) both supplied by USI, Antwerp, Belgium, Ceracol 39 (polyethylene particles of 5 to 8 μm) supplied by Cera Chemie, Deventer, The Netherlands, Polymist A12 (polyethyelene particles of 5 to 40 μm and melting point 139° C.) supplied by Allied Colloids, Nijvel, Belgium, and Ceridust 3620, 130, 9610F, 9615A, 9630F all supplied by Hoechst, Germany;

Amide wax particles consisting of or comprising:

Ceridust 3910 supplied by Hoechst, Germany.

The solid particles can be organic or inorganic. Examples of inorganic particles are:

amorphous silica such as Syloid 378 (Grace)

dolomite particles such as Microdol Super (Norwegian Talc)

calcium carbonate particles.

As organic particles, crosslinked polymers are highly preferred. Examples are poly(styrene-divinylbenzene) copolymers, crosslinked polymethylmethacrylate, crosslinked polysiloxanes and polymethylsilylsesquioxane particles.

The polymethylsilylsesquioxan particles are most effective in reducing the sticking tendency of donor layers to the back side of the donor element. Moreover, an excellent uniform density of the image is observed when this type of particles is used.

Examples of polymethylsilylsesquioxan particles that can be used according to the present invention are the following : Tospearl 120, Tospearl 145, Tospearl 240, Tospearl 130, all being supplied by General Electric, Netherlands, and KMP590 supplied by Shinetsu Silicone.

The use of monodisperse polymethylsilylsesquioxane particles having a weight average particle size of 1.5 to 6 μm is especially preferred.

It may be advantageous to use a mixture of different types of particles. The particles may be applied in another layer at the donor layer side of the support of the donor element such as e.g. in the subbing layer, provided that the particles protrude from the surface of the donor layer. Preferably, the particles are added to the coating solution of the donor layer.

Small particles not protruding from the surface of the donor layer may be added, provided that another type of particles, protruding from the surface is present. Such small particles can be e.g. colloidal silica such as Aerosil R972 (Degussa).

The donor layer may also contain other additives such as i.a. thermal solvents, stabilizers, curing agents, preservatives, dispersing agents, antistatic agents, defoaming agents, and viscosity-controlling agents.

Any material can be used as the support from the donor element provided it is dimensionally stable and capable of withstanding the temperatures involved, up to 400° C. over a period of up to 20 msec, and is yet thin enough to transmit heat applied on one side through to the reducing agent on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. Suitable supports can have a thickness of 3 to 10 μm, preferably a thickness of 4 to 7 μm is used. The support may also be coated with an adhesive or subbing layer, if desired.

Subbing layers comprising aromatic copolyesters, vinylidene chloride copolymers, organic titanate, zirconares and silanes, polyester urethanes and the like can be used.

The donor layer of the donor element can be coated on the support or printed thereon by a printing technique such as a gravure process.

A barrier layer for the reducing agent comprising a hydrophilic polymer may also be employed between the support and the donor layer of the donor element to enhance the transfer of reducing agent by preventing wrong-way transfer of reducing agent backwards to the support. The barrier layer for the reducing agent may contain any hydrophilic material that is useful for the intended purpose. In general, good results can be obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethyleneimine, polyacrylic acid, a mixture of polyvinyl alcohol and polyvinyl acetate, a mixture of polyvinyl alcohol and polyacrylic acid, or a mixture of cellulose monoacetate and polyacrylic acid.

Certain hydrophilic polymers e.g. those described in EP 227,091 also have an adequate adhesion to the support and the donor layer, so that the need for a separate adhesive or subbing layer is avoided. The particular hydrophilic polymers used in a single layer in the donor element thus perform a dual function, hence are referred to as barrier/subbing layers.

The donor element of the present invention can be used in combination with a thermal head, a laser or a resistive ribbon heating system. A thermal head is especially preferred.

Owing to the fact that the thin support softens when heated during the printing operation and then sticks to the thermal printing head, thereby causing malfunction of the printing apparatus and reduction in image quality, the back of the support (the side opposite to that carrying the donor layer) is typically provided with a heat-resistant layer to facilitate passage of the donor element past the thermal printing head. An adhesive layer may be provided between the support and the heat-resistant layer.

Any heat-resistant layer known in the field of thermal sublimation printing or wax printing can be used in the present invention.

The heat-resistant layer generally comprises a lubricant and a binder. In the conventional heat-resistant layers the binder is either a cured binder as described in e.g. EP 153,880, EP 194,106, EP 314,348, EP 329,117, JP 60/151,096, JP 60/229,787, JP 60/229,792, JP 60/229,795, JP 62/48, 589, JP 62/212,192, JP 62/259,889, JP 01/5884, JP 01/56, 587, and JP 92/128,899 or a polymeric thermoplast as described in e.g. EP 267,469, JP 58/187,396, JP 63/191,678, JP 63/191,679, JP 01/234,292, and JP 02/70,485.

During printing, a smooth transport of the donor ribbon and the receiving element is required in order to obtain a good density uniformity all over the print.

It is preferred to use different types of lubricants to allow continuous transport of the donor ribbon relative to the thermal head.

Well known lubricants are polysiloxanes such as those mentioned in EP 267,469, U.S. Pat. No. 4,738,950, U.S. Pat. No. 4,866,028, U.S. Pat. No. 4,753,920 and U.S. Pat. No. 4,782,041. Especially useful slipping agents are polysiloxane-polyether block or graft polymers.

Other lubricants for the heat-resistant slipping layer of the donor element are phosphoric acid derivatives such as those mentioned in EP 153,880 and EP 194,106, metal salts of long fatty acids (such as mentioned in EP 458,538, EP 458,522, EP 314,348, JP 01/241,491 and JP 01/222,993), wax compounds such as polyolefin waxes such as e.g. polyethylene or polypropylene wax, carnauba wax, candelilla wax, bees wax, Elycerine monostearate, amid wax such as ethylene bisstearamide and the like.

A heat-resistant layer such as mentioned in European Patent Application no. 93 202 050.6 is especially preferred.

Inorganic particles such as salts derived from silica such as e.g. talc, clay, china clay, mica, chlorite, silica, or carbonates such as calcium carbonate, magnesium carbonate or calcium magnesium carbonate (dolomite) can be further added to the heat-resistant layer.

It is highly preferred to add mixtures of particles to the heat resistant layer having a Mohs hardness below 2.7 and particles having a Mohs hardness above 2.7 such as mentioned in EP-A-93201642.1.

A mixture of talc and dolomite particles is highly preferred.

A particular heat-resistant layer for the present invention comprises as a binder a polycarbonate derived from a bis-(hydroxyphenyl)-cycloalkane, corresponding to general formula (I):

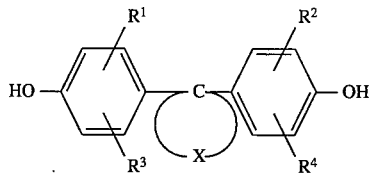

(I)

wherein:

$R^1$, $R^2$, $R^3$, and $R^4$ each independently represents hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, optionally substituted with a $C_1$–$C_6$ alkyl group, a 5- or 6-membered cycloalkyl group or a fused-on 5- or 6-membered cycloalkyl group, as lubricants polyether modified polysiloxane block copolymer and zinc stearate and as particles talc particles with a weight average particle size of 4.5 μm.

Lubricants and binder can be coated in a single layer, or can be casted in a separate layer. It is highly preferred to cast the salt of a fatty acid in the heat resistant layer (e.g, as a dispersion) and the polysiloxane based lubricant in a separate topcoat. This separate topcoat is preferably casted from a non-solvent for the heat-resistant layer.

The heat-resistant layer of the donor element may be coated on the support or printed thereon by a printing technique such as a gravure printing.

The heat-resistant layer thus formed has a thickness of about 0.1 to 3 μm, preferably 0.3 to 1.5 μm.

Preferably a subbing layer is provided between the support and the heat-resistant layer to promote the adhesion between the support and the heat-resistant layer. As subbing layer any of the subbing layers known in the art for dye-donor elements can be used. Suitable binders that can be used for the subbing layer can be chosen from the classes of polyester resins, polyurethane resins, polyester urethane resins, modified dextrans, modified cellulose, and copolymers comprising recurring units such as i.a. vinyl chloride, vinylidene chloride, vinyl acetate, acrylonitrile, methacrylate, acrylate, butadiene, and styrene (e.g. poly(vinylidene chloride-co-acrylonitrile). Suitable subbing layers have been described in e.g. EP 138,483, EP 227,090, European Patent Application No. 92200907.1, U.S. Pat. No. 4,567,113, U.S. Pat. No. 4,572,860, U.S. Pat. No. 4,717,711, U.S. Pat. No. 4,559,273, U.S. Pat. No. 4,695,288, U.S. Pat. No. 4,727,057, U.S. Pat. No. 4,737,486, U.S. Pat. No. 4,965,239, U.S. Pat. No. 4,753,921, U.S. Pat. No. 4,895,830, U.S. Pat. No. 4,929,592, U.S. Pat. No. 4,748,150, U.S. Pat. No. 4,965,238, and U.S. Pat. No. 4,965,241.

The receiving element for use according to the printing method of the present invention comprises a receiving layer provided on a support, said receiving layer comprising a silver source capable of being reduced by means of heat in the presence of a reducing agent.

The reducible silver source may comprise any material that contains a reducible source of silver ions. Silver salts of organic and hereto-organic acids, particularly long chain fatty carboxylic acids (comprising from 10 to 30, preferably 15 to 25 carbon atoms) are preferred. Complexes of organic or inorganic silver salts in which the ligand has a gross stability constant for silver ion of between 4.0 and 10.0 are also useful. Examples of suitable silver salts are disclosed in Research Disclosure Nos. 17029 and 29963 and include: salts of organic acids, e.g., gallic acid, oxalic acid, behenic acid, stearic acid, palmitic acid, lauric acid and the like: silver carboxyalkylthiourea salts, e.g., 1-(3-carboxypropyl)thiourea, 1-(3-carboxypropyl)-3,3-dimethylthiourea and the like; complexes of silver with the polymeric reaction product of an aldehyde with a hydroxy-substituted aromatic carboxylic acid, e.g., aldehydes, such as formaldehyde, acetaldehyde and butyraldehyde, and hydroxy-substituted acids, such as salicyclic acid, benzilic acid, 3,5odihydroxybenzilic acid and 5,5-thiodisalicylic acid; silver salts or complexes of thiones, e.g., 3-(2-carboxyethyl)-4-hydroxymethyl-4-thiazoline-2-thione and 3-carboxymethyl-4-methyl-4-thiazoline-2-thione; complexes of salts of silver with nitrogen acids selected from imidazole, pyrazole, urazole, 1,2,4-triazole and 1H-tetrazole, 3-amino-5-benzylthio-1,2,4-triazole and benzotriazole; silver salts of saccharin, 5-chlorosalicylaldoxime and the like; and silver salts of mercaptides. The preferred silver source is silver behenate.

The silver source is preferably added as a dispersion to the coating liquid of the receiving layer.

As binding agent for the receiving layer preferably thermoplastic water insoluble resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, polymers derived from α,β-ethylenically unsatured compounds such as polyvinyl chloride, after chlorinated polyvinyl chloride, copolymers of vinyl chloride and vinylidene chloride, copolymers of vinyl chloride and vinyl acetate, polyvinyl acetate and partially hydrolysed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene or mixtures thereof. A particularly suitable ecologically interesting (halogen-free) binder is polyvinyl butyral. A polyvinyl butyral containing some vinyl alcohol units is marketed under the trade name BUTVAR B79 of Monsanto USA.

The binder to organic silver salt weight ratio is preferably in the range of 0.2 to 6, and the thickness of the image forming layer is preferably in the range of 5 to 16 μm.

It is preferred to use a so-called toning agent in the receiving layer or in a layer adjacent to said receiving layer. This toning agent serves to change the tone of the silver image from brown to black or grey. Suitable toning agents are e.g. phthalazinone, phthalazine, phthalimide, succinimide, phthalic acid, benzimidazole or a compound according to formula (II):

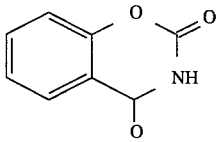

(II)

The use of phthalazinone or compound (II) or a mixture thereof is highly preferred.

It is highly preferred to use a release agent in the receiving element on the side of the receiving layer. This release agent may be added to the coating solution of the receiving layer or may be applied, optionally in a mixture with other ingredients, as a separate layer called the release layer on top of said receiving layer. The use of a release layer is preferred, since the release agent is in that case on top of the receiving element.

The use of a release agent is preferred in the printing method of the present invention since the reducing agents useful in the present invention can give rise to a sticky contact between donor element and receiving element.

As release agents, inorganic and organic release agents can be used. Among them, the organic release agents are preferred.

Solid waxes, fluorine- or phosphate-containing surfactants and silicone oils can be used as releasing agent. Suitable releasing agents have been described in e.g. EP 133012, JP 85/19138, and EP 227092. The use of silicon oils, silicon block copolymers and functionalised polysiloxanes is especially preferred. Examples are Tegomer H SI 2111, Tegoglide 410 (both tradenames of Goldschmidt), Silicon fluid L054 (tradename of Wacker) and KF 393 (Tradename of Shinetsu).

When, as mentioned above, a separate release layer, incorporating the release agent, is coated on top of said receiving layer, other ingredients such as binders, plasticizers, or particulate fillers such as talc, silica or collodial particles can be added to said release layer, provided that the transfer of the reducing agent to the receiving layer comprising the reducible silver source can take place.

Examples of binders for the release layer are polyvinylbutyral, ethylcellulose, cellulose acetate propionate, cellulose acetate butyrate, polyvinylchloride, copolymers of vinylchloride, vinylacetate and vinylalcohol, aromatic or aliphatic copolyesters, polymethylmethacrylate, polycarbonates derived from bisphenol A, polycarbonates comprising bisphenols according to formula (I) and the like. The release layer can also act as a protective layer for the images. The use of ethylcellulose or polyvinyl butyral as binder for the release layer is highly preferred. The binder may be hardened in order to improve the release properties of the release layer. Suitable hardeners are tetramethylorthosilicate and polyisocyanates such as e.g. toluenediisocyanate.

A subbing layer is usually provided between the support and the receiving layer, such as those mentioned in e.g. U.S. Pat. No. 4,748,150, U.S. Pat. No. 4,954,241, U.S. Pat. No. 4,965,239 and U.S. Pat. No. 4,965,238 and European Patent Application no. 92 201 620.9.

The support for the receiver sheet may be a transparent film of e.g. polyethylene terephthalate, a polyether sulfone, a polyimide, a cellulose ester, or a polyvinyl alcohol-co-acetal. The support may also be a reflective one such as baryta-coated paper, polyethylene-coated paper, or white polyester i.e. white-pigmented polyester. Blue-colored polyethylene terephthalate film can also be used as a support.

At the opposite side of the receiving element (opposite to the receiving layer), a backcoat can be provided, optionally in combination, with an appropriate subbing layer to improve the adhesion between the backcoat and the support.

Hydrophilic as well as hydrophobic backcoats can be used. Hydrophilic backcoats can be applied easily from water, while hydrophobic backcoats have the advantage that the backcoat performs well at all humidity levels (no curl).

Examples of hydrophilic backcoat layers are layers comprising polyvinylalcohol, polyethylene glycol, polyacrylamide, hydroxyethylcellulose, dextran and gelatin. The use of gelatin is highly preferred.

These hydrophilic backcoat layers may further comprise dispersions or latices of hydrophobic polymers, inorganic particles, surfactant and the like. The addition of these particles can be used in order to obtain a specific surface gloss, such as mentioned in European patent application no. 91 203 008.7. Especially preferred particles are silica and polymethylmethacrylate beads of 0.5 to 10 μm. Antistatic treatment can also be provided to said backcoat layer.

Examples of hydrophobic backcoat layers are backcoat layers comprising addition polymers such as polymethylmethacrylate, polyvinylchloride and polycondensates such as polyesters, polycarbonates in combination with the above mentioned particles for the hydrophilic backcoat layers.

With hydrophobic backcoat layers, it can be useful to provide an intermediate hydrophilic layer between the subbing layer and the backcoat layer, such as those mentioned for use at the receiving side of the receiving element, in order to improve the removal of the backcoat layer in the recycling procedure.

The printing method of the present invention uses preferably a thermal head to selectively heat specific portions of the donor element in contact with a receiving element. The thermal head can be a thick or thin film thermal head although the use of a thin film thermal head is preferred, since this offers more opportunities to obtain appropriate gradation. The pressure applied to the thermal head is preferably between 120 and 400 g/cm heater line. It is highly preferred to use a pressure of at least 160 g/cm heater line and more preferably at least 250 g/cm heater line. This high pressure is preferred in order to give an intimate contact between the donor element and the receiving element. This intimate contact may be critical in the present invention because the particles protruding from the donor layer are preferably pressed in the receiving layer of the receiving element. A spatial resolution of 150 dpi or more is preferred.

The average printing power is calculated as the total amount of energy applied during one line time divided by the line time and by the surface area of the heat-generating elements. Although a higher average printing power results in higher optical densities of the final image, it is preferred to use an average printing power below 10 W/mm$^2$. At higher printing energies, deformation of the receiving layer and/or receiving sheet occurs.

The time needed for printing one single line with the thermal head, also called the line time, is preferably below 45 ms. Longer line times result in longer printing times and more deformation of the receiving sheet and/or receiving layer.

In order to increase the density of the final image after printing line-by-line with a thermal head, an overall heat treatment of the receiving element may be performed. This heat treatmenu can be e.g. done with an infrared source, a heated air stream or a hot plate but is preferably done by means of a heated roller.

It is believed that during the overall heat treatment, the transferred reducing agent can further react with the reducible silver source.

By selecting the appropriate diameter and speed of the heated roller, the heat treatment time for the overall heating can be adjusted. Moreover, the heated rollers can be used to uncurl the receiving sheet after printing.

The following examples illustrate the invention in more detail without, however, limiting the scope thereof.

EXAMPLES

Preparation of the receiving sheets

A subbed polyethylene terephthalate support having a thickness of 100 μm was coated in order to obtain the following receiving layer:

| layer: | |
|---|---|
| silver behenate | 4.5 g/m$^2$ |
| compound II mentioned above | 0.34 g/m$^2$ |
| polyvinylbutyral (Butvar B79, Monsanto) | 4.5 g/m$^2$ |

After drying, a release layer was coated from hexane comprising 0.03 g/m$^2$ Tegoglide 410 (polyether-polysiloxane blockcopolymer from Goldschmidt). This receiving element was used in the following printing examples.

Preparation of the donor elements

Both sides of a 5.7 μm thick polyethylene terephthalate support were coated with a subbing layer of a copolyester comprising ethylene glycol, adipic acid, neopentyl glycol, terephthalatic acid, isophthalic acid, and glycerol.

The resulting subbing layer was covered with a solution in methyl ethyl ketone of 13% of a polycarbonate having the following structural formula (III):

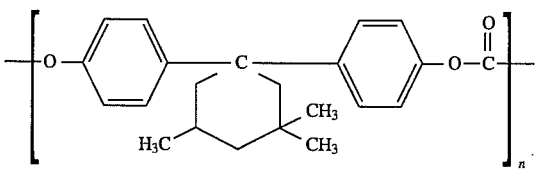

(III)

wherein n represents the number of units to obtain a polycarbonate having a relative viscosity of 1.30 as measured in a 0.5% solution in dichloromethane, 0.5% of talc (Nippon Talc P3, Interorgana) and 0.5% of zinc stearate.

Finally, a top layer of polyether-modified polydimethylsiloxane (Tegoglide 410, Goldschmidt) was coated from a solution in isopropanol on the resulting heat-resistant polycarbonate layer.

The other side of the support was provided with a donor layer. The nature of the ingredients is mentioned in table 1.

The amount of particles in table 1 are all expressed as weight percentages in the coating solution. The binder was always used at 13 weight % and the reducing agent at 10 weight %. Butanone was used as the coating solvent.

These coating solutions were applied at a wet thickness of 10 μm by means of a wire bar. The resulting layer was dried by evaporation of the solvent.

Printing of the combination of donor and receiving elements

Printing was performed by contacting the donor layer of the donor element with the receiving layer of the receiving element, followed by heating by means of a thermal head. The thermal head was a thin film thermal head heated (pulse wise activation) at an average printing power of 5 Watt/mm$^2$ and a line time of 18 ms, a duty cycle of 75% and with a resolution of 300 dpi. The pressure applied between the thermal head and the rotating drum carrying the receiving and donor element was 160 g/cm heater line. After printing, the receiving element was separated from the donor element.

The printed image was a 16-step grey scale between data level 0 and 255 (8 bit). The data levels of the different steps were choosen equidistant with respect to the input data level in order to obtain the native sensitometry.

Overall heat treatment

All receiving elements were reheated on a hot plate of 118° C. for 10 seconds.

Measurement of the optical density of the prints

The optical maximal densities of the prints were measured behind a visual filter in a Macbeth TR924 densitometer in the grey scale part corresponding to data level 255.

Evaluation of the density uniformity

The density uniformity of a printed image was inspected visually in the grey scale part corresponding to densities 0.1 to 1.0 on a light box.

Density uniformity at low density

M: moderate uniformity

G: good uniformity

E: excellent uniformity

Stability of the reductor donor element

The storage stability of the donor element was evaluated by rolling a reductor donor element on a tube, thereby contacting the donor layer with the heat-resistant layer on the other side of the support. The degree of sticking was evaluated after 7 days storage at 35° C./80% relative humidity and at 45° C./70% relative humidity.

The following criteria were used:

B: Bad: extensive sticking, resulting in transfer of donor layer to the back side of the donor element.

M: Moderate: moderate sticking, not resulting in transfer of donor layer to the back side of the donor element.

G: Good: approximately no sticking.

E: Excellent: no sticking at all.

TABLE 1

| Experiment number | Binder | Reducing agent | Particle Type | Particle Concentration (%) |
|---|---|---|---|---|
| 1 (comp) | B1 | R1 | — | — |
| 2 (comp) | B1 | R2 | — | — |
| 3 (comp) | B2 | R1 | — | — |
| 4 | B1 | R1 | P1 | 0.5 |

TABLE 1-continued

| Experiment number | Binder | Reducing agent | Particle Type | Particle Concentration (%) |
|---|---|---|---|---|
| 5 | B1 | R1 | P1 | 1 |
| 6 | B1 | R1 | P2 | 0.25 |
| 7 | B1 | R1 | P2 | 0.5 |
| 8 | B1 | R1 | P3 | 0.5 |
| 9 | B1 | R1 | P3 | 1 |
| 10 | B1 | R1 | P4 | 0.5 |
| 11 | B1 | R1 | P4 | 1 |
| 12 | B1 | R1 | P5 | 0.5 |
| 13 | B1 | R1 | P6 | 0.5 |
| 14 | B1 | R2 | P2 | 0.5 |
| 15 | B2 | R1 | P2 | 0.5 |

Binders

B1: Poly(styrene-co-acrylonitrile) Luran 388S (tradename of BASF)

B2: Ethylcollulose N7 (tradename of Hercules)

Reducing agents

R1: 4-phenylpyrocatechol

R2: propylgallate

Particles

P1: Tospearl 120 (Toshiba Silicone), polymethylsilylsesquioxane particles 2 μm

P2: Tospearl 145 (Toshiba Silicone), polymethylsilylsesquioxane particles 4.5 μm P3: Ceridust 3910 (Hoechst), ethylenebisstearamide particles 2–10 μm P4: MPP620XF (Micro Powders), polyethylene wax particles 2–10 μm P5: Syloid 378, amorphous silica, average particle size 4.5 μm P6: KMP590 (Shinetsu silicone), polymethylsilylsesquioxane particles 1.5 μm.

TABLE 2

| | Optical density | Storage stability 35° C./89% RH | Storage stability 45° C./70% RH | Density uniformity |
|---|---|---|---|---|
| 1 (comp) | 1.64 | B | B | E |
| 2 (comp) | 1.45 | B | B | E |
| 3 (comp) | 2.12 | B | B | E |
| 4 | 1.90 | E | E | E |
| 5 | 1.87 | E | E | E |
| 6 | 1.84 | E | E | E |
| 7 | 1.81 | E | G | G |
| 8 | 1.80 | E | M | G |
| 9 | 1.76 | E | G | M |
| 10 | 1.79 | E | G | G |
| 11 | 1.73 | E | E | G |
| 12 | 1.82 | E | E | M |
| 13 | 1.91 | E | E | E |
| 14 | 1.49 | E | E | G |
| 15 | 2.12 | M | M | G |

It can be seen from tables 1 and 2 that donor elements of the present invention have an excellent storage stability (no sticking during storage in rolled form). It is also clearly demonstrated that the density uniformity is excellent when monodisperse polymethylsilylsequioxane particles are used.

What is claimed is:

1. A thermal imaging process comprising, in order, the steps of:

a) bringing a donor layer of a donor element into face to face relationship with a receiving layer of a receiving element to obtain an assemblage, b) image-wise heating the assemblage, thereby causing image-wise transfer of an amount of a thermotransferable reducing agent to said receiving element in accordance with the amount of heat supplied by said thermal head, c) separating said donor element from said receiving element, and d) overall heating said receiving element, wherein (i) said donor element comprises said donor layer on a support, wherein said donor layer comprises a binder, and thermotransferable reducing agent which is capable of reducing a silver source to metallic silver upon heating, and particles protruding from the surface of said donor layer, wherein (ii) said receiving element comprises said receiving layer on a support, and said receiving layer comprises a silver source which is capable of being reduced by means of heat in the presence of a reducing agent.

2. A thermal imaging process according to claim 1, wherein said particles protruding from said donor layer are selected from the group consisting of inorganic particles, insoluble organic particles and wax particles.

3. A thermal imaging process according to claim 2, wherein said wax particles are selected from the group consisting of amid waxes, ester waxes and polyolefin waxes.

4. A thermal imaging process according to claim 2, wherein said insoluble organic particles are crosslinked polymer particles.

5. A thermal imaging process according to claim 4, wherein said crosslinked organic particles are polymethylsilylsesquioxane particles.

6. A thermal imaging process according to claim 1, wherein said particles have a weight average particle size of 1.5 to 8 μm.

7. A thermal imaging process according to claim 1 wherein said image-wise heating is carried out by means of a thermal head.

8. A thermal imaging process according to claim 7 wherein the pressure for contacting said donor element and said receiving element during image-wise printing is more than 120 g/cm heater line of said thermal head.

* * * * *